United States Patent [19]

Notenboom

[11] 4,456,227

[45] Jun. 26, 1984

[54] DUAL-HANDLED WINCH

[75] Inventor: Leo J. Notenboom, King County, Wash.

[73] Assignee: Genie Industries, Inc., Redmond, Wash.

[21] Appl. No.: 360,837

[22] Filed: Mar. 23, 1982

[51] Int. Cl.[3] ..... B66D 1/04; B66D 1/54

[52] U.S. Cl. ..... 254/350; 254/357; 254/376

[58] Field of Search ..... 254/350, 357, 376

[56] References Cited

U.S. PATENT DOCUMENTS

| | | | |
|---|---|---|---|
| 1,482,924 | 2/1924 | Hescock | 254/350 X |
| 2,390,891 | 12/1945 | Martin | 254/350 |
| 2,626,126 | 1/1953 | Sasgen | 254/357 |
| 2,776,815 | 1/1957 | Sheard | 254/357 X |
| 3,939,729 | 2/1976 | Brockelsby | 254/357 X |

*Primary Examiner*—John Petrakes

*Attorney, Agent, or Firm*—Seed and Berry

[57] ABSTRACT

A dual-handled manual winch has a ratchet wheel meshing constantly with a pawl and which is automatically frictionally locked to a drive pinion for the winch drum when the drum starts to overrun. The drive pinion is threaded into a drive shaft on the ends of which the handles are mounted in diametrically opposite relation and on which the ratchet wheel and a pair of friction washers are sleeved to be engaged between the pinion and the ratchet wheel, and between the ratchet wheel and a stop collar on the shaft, responsive to axial movement of the drive pinion in the shaft toward the ratchet wheel.

8 Claims, 4 Drawing Figures

DUAL-HANDLED WINCH

DESCRIPTION

1. Technical Field

The present invention relates to manual winches of the friction lock type in which a ratchet gear is frictionally locked to the drive shaft whenever the winch drum starts to turn the shaft faster than the handle is being turned in the load releasing direction.

2. Background Art

In a friction lock type of manual winch, as commonly used, there is a single handle threaded on one end of a drive shaft so that as the handle is turned clockwise in a winding-up direction, the handle hub forces a friction washer against a ratchet wheel slide-mounted on the shaft and meshing with a spring-loaded pawl. As the ratchet wheel then responsively moves axially, it engages a second friction washer, which, in turn, is forced against a stop flange fixed on the shaft, which may be one end of a drive pinion on the shaft meshing with a driven gear on the winch drum. Accordingly, the ratchet wheel becomes clamped between the handle hub and the drive pinion via the friction washers. When it is desired to unwind the winch drum, the handle is turned counterclockwise relative to the drive shaft. This movement releases the ratchet wheel relative to the drive shaft. However, if the winch drum then starts to unwind so fast to turn the drive shaft counterclockwise faster than the handle is being turned manually in the counterclockwise direction, thereby in effect turning the handle clockwise relative to the drive shaft, the handle will again move toward the drive pinion and cause the ratchet wheel to again be locked relative to the drive shaft.

DISCLOSURE OF INVENTION

In the past, the winches of the type described have only one handle for manual operation. The present invention provides a friction lock type of manual winch in which the drive shaft has handles at both ends of the drive shaft extending in diametrically opposite directions so that the operator may use both hands in the most effective manner to take up a load by the winch. As before, the winch drum is gear-coupled to the drive shaft via a drive pinion.

In carrying out the invention, the handles are constantly fixed to the drive shaft and the drive pinion is threaded onto the shaft so as to walk relative to the shaft and winch drum toward and away from a slide-mounted ratchet wheel responsive to turning of the handles in the clockwise and counterclockwise directions, respectively. The ratchet wheel constantly meshes with a pawl, preventing movement of the ratchet wheel in the counterclockwise direction. When the drive pinion walks toward the ratchet wheel responsive to clockwise turning of the handles, it causes the ratchet wheel to be clamped between the drive pinion and a stop flange on the drive shaft via two friction washers, one being located between the drive pinion and the ratchet gear, and the other being located between the ratchet wheel and the stop flange. The ratchet pawl then prevents unwinding of the winch drum. Counterclockwise turning of the handle eases off the clamping of the ratchet wheel so that the drive shaft can turn counterclockwise relative thereto, thereby permitting unwinding motion of the winch drum.

BEST MODE FOR CARRYING OUT THE INVENTION

Figure 1:
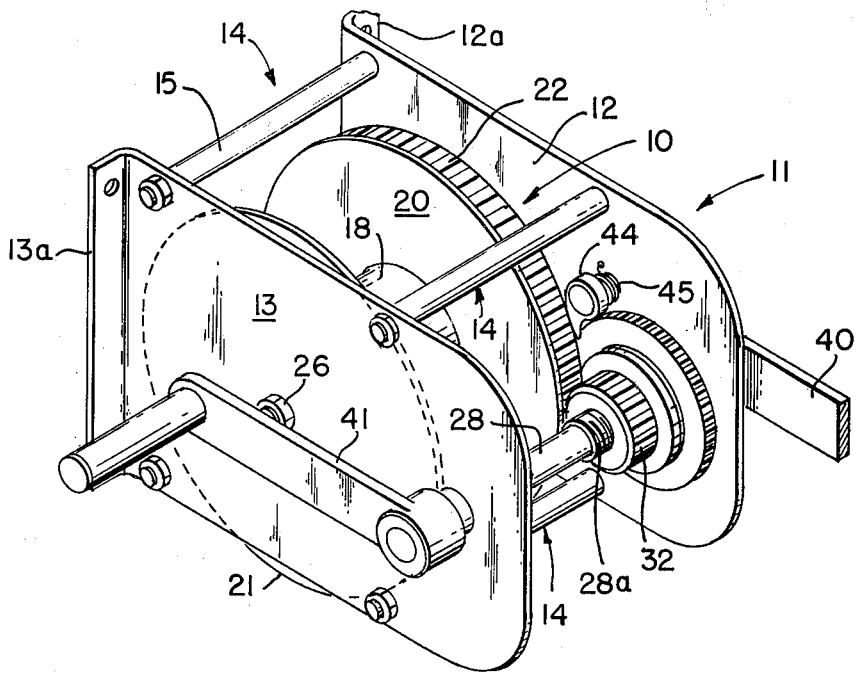
FIG. 1 is an isometric view of a winch embodying the present invention.
Figure 2:
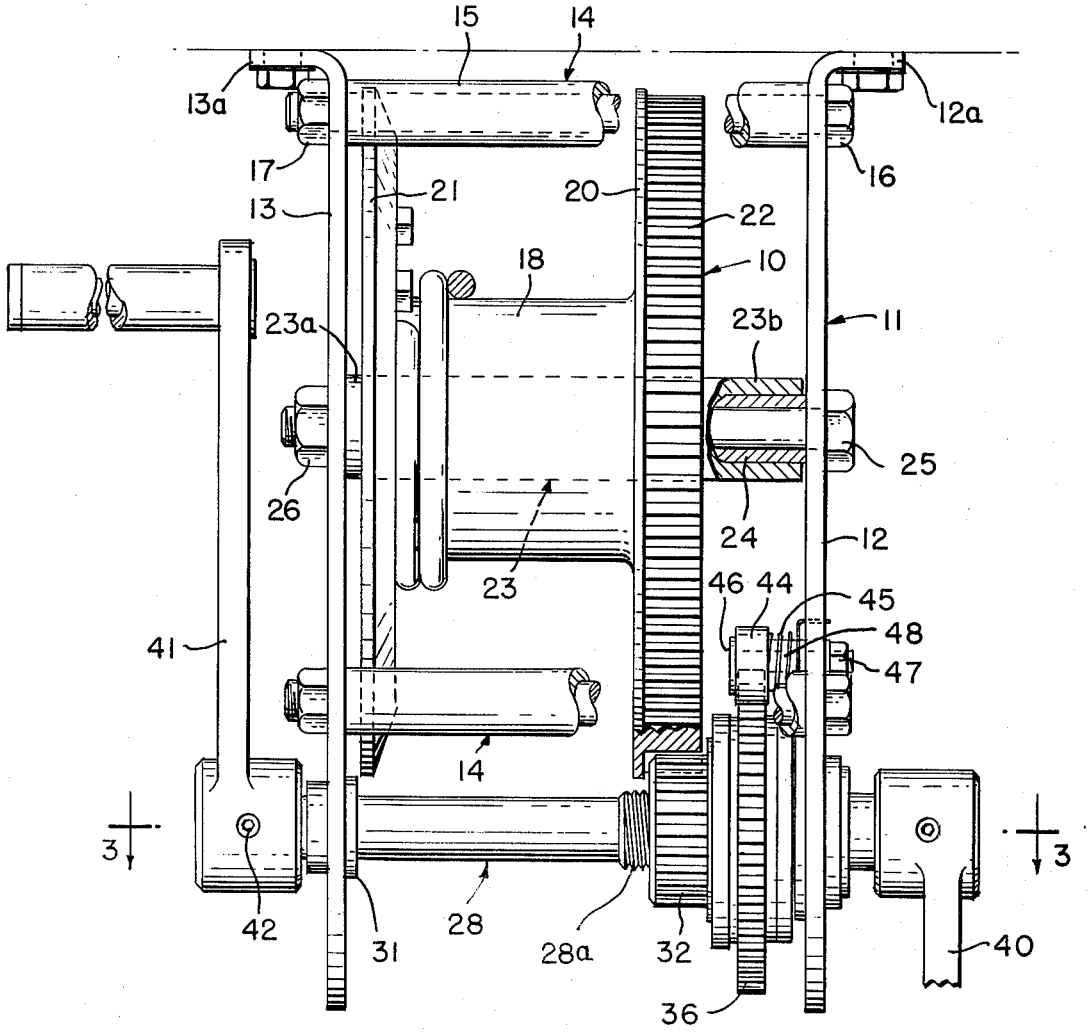
FIG. 2 is a top plan of the winch with the ratchet wheel engaged, some of the parts being broken away into section.
Figure 3:
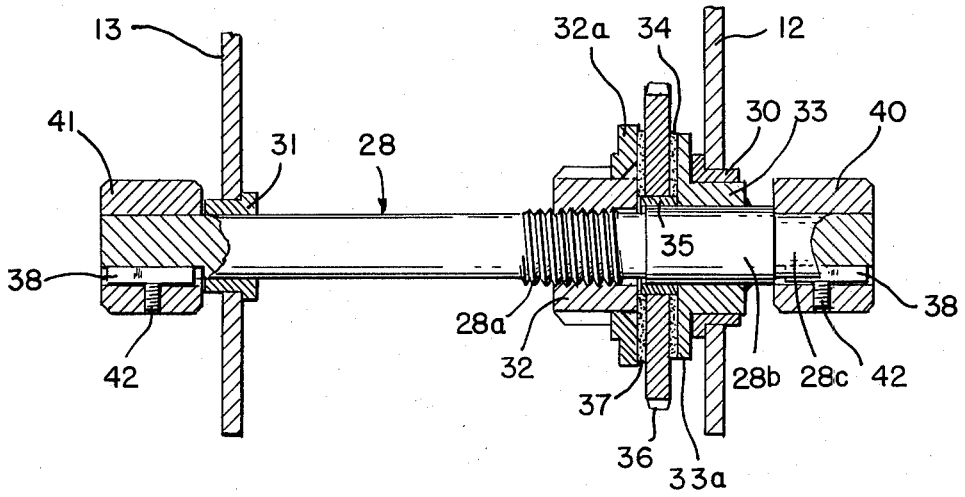
FIG. 3 is a sectional view taken along the line 3—3 of FIG. 2.

Referring to the drawings, it is seen that a winch drum 10 is journal-mounted in a frame 11 comprising a pair of right and left end plates 12-13 interconnected by four spacer units 14 arranged in a rectangular configuration. Each spacer unit is made up of a spacer tube 15, a bolt 16 extending through the tube 15 and aligned openings in the end plates 12-13, and a nut 17 tightened on the bolt to pull the end plates snugly against the ends of the spacer tube 15. At their ends, the end plates 12-13 are bent outwardly to provide mounting flanges **12*a*-13*a*** formed with holes for mounting bolts.

The winch drum 10 has its spool 18 fixed to round cheeks 20-21. It will be noted that the left cheek 21 is preferably dished inwardly for strength, whereas the right cheek 20 is flat and secured to a ring gear 22. Extending axially through the spool 18 and welded to the cheeks 20-21 is a hub tube 23 which is slightly shorter in length than the spacer tubes 15. The hub tube 23 pojects as a hub **23*a* a short distance beyond the left cheek 21 and preferably projects axially at 23*b* beyond the gear 22 a longer distance as a spacer to provide adequate room between the gear 22 and the end plate 12 for an operating mechanism (to be described). The hub tube 23 is journaled on a bearing sleeve 24 which receives therethrough a bolt 25 passing through holes in the end plates 12-13 and having a nut 26. The bearing sleeve 24 is preferably the same length as the four spacers 15 so that when the nut 26 is tightened, the end plates 12-13 snugly engage the bearing sleve as well as the spacers 15**.

The end plates 12-13 project forwardly beyond the winch drum 10 to receive a drive shaft 28 journaled in bushings 30-31 mounted in openings through the end plates. It will be noted that the drive shaft has an intermediate threaded portion **28*a* on which is threaded the hub of a pinion 32 meshing with the ring gear 22. To the right of the threaded portion 28*a*, the drive shaft has a radially enlarged portion 28*b* on which is fixed, as by welding, a collar 33 which extends axially through the bushing 30. At its inner end, the collar 33 is formed with an annular stop flange 33*a* opposed by a metal friction washer 34. This washer slide fits over a short bearing sleeve 35 on the enlarged shaft portion 28*b* extending from the left end thereof to the stop flange 33*a*. Also slide-mounted on the sleeve 35 is a toothed ratchet wheel 36 and a fiber friction washer 37 which opposes the outer face of an enlarged flange 32*a* provided on the right end of the pinion 32. The right end of the shaft 28 is necked at 28*c* and both ends of the shaft are splined for keys 38** received in the splined hubs of crank handles 40-41 and held by set screws 42 bearing against the keys 38. The handles extend in diametrically opposite directions.

Engaging the ratchet wheel 36 is a pawl 44 journaled on the neck of a necked spacer 45 which is in turn sleeved on a bolt 46 having its head engaging the necked inner end of the spacer 45. The other end of the bolt passes through the end plate 12 and receives a nut 47. The pawl 44 is spring-loaded into meshing engagement with the teeth of the ratchet wheel 36 by a coil spring 48 having one of its ends passing through a hole in the hub of the pawl 44 parallel to the axis thereof and its other end passing through a hole in the end plate 12. A second such pawl may be provided as a backup in case of spring failure.

Figure 4:
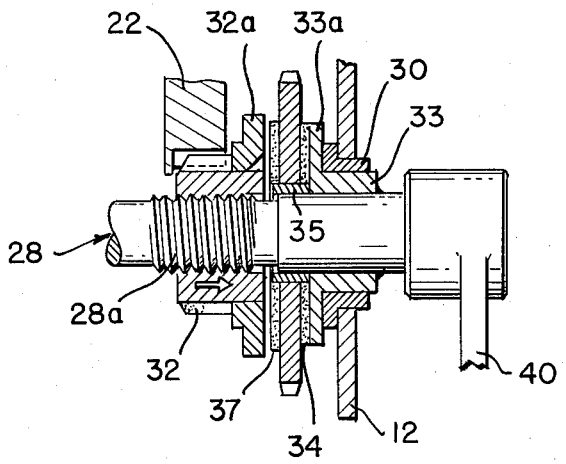
FIG. 4 is a sectional view taken as in FIG. 3, but showing the mechanism with the ratchet wheel disengaged and indicating by an arrow the direction of movement for reengaging the ratchet wheel, the spacing between the left friction washer and the adjoining parts being exaggerated.

As viewed from the handle 40, the threaded shaft portion 28*a* has right-hand threads so that when the handles 40-41 are manually turned in the clockwise direction, the pinion 32 is caused to walk to the right relative to the ring gear 22 and shaft 28 into engagement with the friction washer 37. This causes the floating ratchet wheel 36 to be pinched between the friction washers 34,37 and the friction washer 34 to be pressed against the flange 33*a*. As a result, the ratchet wheel 36 and pinion 32 become fixed relative to the shaft 28, whereupon further turning of the shaft 28 by the handles 40-41 winds up cable on the drum 10, and the pawl 44 and ratchet gear 36 are active to prevent the drum 10 from reversing direction into a cable unwinding rotation. To let out cable, the handles 40-41 are turned counterclockwise, thereby causing the pinion 32 to walk slightly to the left relative to the shaft 28 and ring gear 22. This walking movement of the pinion 32 releases the ratchet wheel 36 relative to the pinion 32 and shaft 28 (see FIG. 4) so that the drum 10 is then free to unwind as the handles are further turned counterclockwise. However, if the drum 10 then starts to overrun the shaft 28, the over-running movement causes the pinion 32 to start to walk back to the right, as indicated by the arrow in FIG. 4, to again lock the ratchet wheel 36 to the shaft. Hence, it is impossible for the winch operator to lose control while the winch drum is being unwound under load.

While particular embodiments of the invention have been shown and described, it should be understood that the invention is not limited thereto since many modifications may be made. It is therefore contemplated to cover by the present application any and all such modifications that fall within the true spirit and scope of the invention claimed herein.

I claim:

1. A winch comprising:

a frame;

a winch drum journal-mounted on the frame and including a ring gear;

a shaft journal-mounted on the frame having hand cranks fixed on its opposite ends and extending in diametrically opposite directions;

a pinion threaded onto said shaft intermediate the ends and meshing with said ring gear, said pinion being axially movable relative to said ring gear by sliding engagement between the meshing teeth of pinion and ring gear in the axial direction;

ratchet means including a ratchet wheel sleeved on said shaft, said ratchet means preventing unwinding of the winch drum when the ratchet wheel is coupled to the pinion; and means for coupling said ratchet wheel to said pinion and shaft when said pinion moves axially on said shaft toward said pinion responsive to turning of the shaft relative to the pinion in one direction and for uncoupling said ratchet wheel from said pinion and shaft when said pinion moves on said shaft away from said pinion responsive to turning of the shaft relative to the pinion in the opposite direction wherein the ring gear, pinion and ratchet means insures that revolution of the winch drum is controllable while unwinding under load since the pinion will engage the ratchet means as a brake if the winch drum overruns the shaft.

2. A winch according to claim 1 in which said means for coupling includes a stop flange fixed on said shaft and facing toward said ratchet wheel and pinion, and friction coupling means between said pinion and said ratchet wheel and between said stop flange and said ratchet wheel for coupling said pinion, ratchet wheel and shaft together against rotation relative to one another when said pinion moves axially on said shaft toward said stop flange.

3. A winch according to claim 2 in which said friction coupling means comprises two friction washers sleeved on the shaft, one washer spaced on each side of the ratchet wheel.

4. A winch according to claim 2 in which said ratchet means further includes a pawl journal-mounted on said frame and spring-loaded into meshing engagement with the ratchet wheel.

5. A winch according to claim 1 in which said ratchet means further includes a pawl journal-mounted on said frame and spring-loaded into meshing engagement with the ratchet wheel.

6. For a winch a shaft with a threaded portion intermediate its ends and a stop shoulder facing said threaded portion and spaced therefrom, the shaft including at least one handle for controlling movement of the winch both clockwise and counterclockwise;

a pinion screw-mounted on said threaded portion;

a ratchet wheel sleeved on the shaft between the pinion and the stop shoulder;

friction means between said pinion and ratchet wheel and between the ratchet wheel and stop shoulder for coupling the pinion, ratchet wheel and shaft means together responsive to movement of the pinion along the shaft toward the ratchet wheel and stop shoulder; and a winch drum including a ring gear which meshes with the pinion, wherein the ring gear, pinion, and ratchet wheel insures that resolution of the winch drum is controllable while unwinding under load, since the pinion will engage the ratchet wheel and couple with it as a brake if the winch drum overruns the shaft.

7. The apparatus of claim 6, further comprising a pawl journal-mounted through a frame which in turn holds the shaft, the pawl being spring-loaded into meshing engagement with the ratchet wheel to act as a brake for rotation of the ratchet wheel in one rotational sense.

8. The apparatus of claim 6 wherein the pinion is axially movable relative to the ring gear by sliding engagement between the meshing teeth of the pinion and ring gear in the axial direction.

* * * * *